United States Patent [19]

Yoneyama et al.

[11] 4,213,803

[45] Jul. 22, 1980

[54] $R_2Co_{17}$ RARE TYPE-EARTH-COBALT, PERMANENT MAGNET MATERIAL AND PROCESS FOR PRODUCING THE SAME

[75] Inventors: Tetsuhito Yoneyama; Shiro Tomizawa, both of Ichikawa; Tetsuo Hori, Tokyo; Teruhiko Ojima, Nagareyama, all of Japan

[73] Assignee: TDK Electronics Company Limited, Tokyo, Japan

[21] Appl. No.: 766,671

[22] Filed: Feb. 8, 1977

[30] Foreign Application Priority Data

Aug. 31, 1976 [JP] Japan ..... 51-103919
Dec. 28, 1976 [JP] Japan ..... 51-159465

[51] Int. Cl.[2] ..... H01F 1/08

[52] U.S. Cl. ..... 148/102; 75/170; 148/31.57

[58] Field of Search ..... 148/101, 103, 108, 31.57, 148/102; 75/152, 170, 0.5 R

[56] References Cited

U.S. PATENT DOCUMENTS

| | | | |
|---|---|---|---|
| 3,546,030 | 12/1970 | Buschow et al. | 148/31.57 |
| 3,695,945 | 10/1972 | Benz | 148/103 |
| 3,701,695 | 10/1972 | Buschow et al. | 148/103 |
| 3,839,101 | 10/1974 | Doser | 148/101 |
| 3,926,832 | 12/1975 | Barosi | 75/0.5 R |
| 3,947,295 | 3/1976 | Tawara et al. | 148/31.57 |
| 3,970,484 | 7/1976 | Doser et al. | 148/103 |
| 3,982,971 | 9/1976 | Yamanaka et al. | 148/31.57 |
| 4,047,982 | 9/1977 | Sagawa et al. | 148/101 |
| 4,075,437 | 2/1978 | Chin et al. | 148/31.57 |
| 4,081,297 | 3/1978 | Nogel et al. | 148/31.57 |

OTHER PUBLICATIONS

Strnat, K. et al., Magnetic Properties of Rare Earth Iron Intermetallic Compounds, IEEE Transactions on Magnetics, pp. 489–493 (9/66).

*Primary Examiner*—L. Dewayne Rutledge
*Assistant Examiner*—Michael L. Lewis
*Attorney, Agent, or Firm*—Norman P. Friederichs

[57] ABSTRACT

Disclosed is the addition of at least two elements of Nb, V, Ta and Zr to the ternary alloy of R (rare earth)-Co-Cu for permanent magnet materials, to thereby provide the permanent magnets with increased coercive force, residual magnetization and energy product. The additional elements enable employment of such Cu and Fe contents of the alloy as less than 10% and more than 6%, respectively. These percentages were avoided in the prior art to prevent the reduction of Br and Hc, respectively.

36 Claims, 4 Drawing Figures

$R_2CO_{17}$ RARE TYPE-EARTH-COBALT, PERMANENT MAGNET MATERIAL AND PROCESS FOR PRODUCING THE SAME

The present invention relates to a permanent magnet material and, more particularly, to an improvement of a permanent magnet material consisting essentially of intermetallic compounds of the general formula of $R_2Co_{17}$, wherein the R component is at least one rare earth metal and the Co component is cobalt, as well as to a suited process to produce the permanent magnet material according to the invention.

The prior art of the rare earth cobalt permanent magnets includes U.S. Pat. Nos. 3,421,889 and 3,560,200. The former U.S. Patent discloses a basic composition of the rare earth metal and cobalt. The latter U.S. Patent discloses incorporation of copper, in an amount greater than 1.7 atomic percent to less than 71.5 atomic percent, into the basic compositions of the rare earth metal and cobalt, thereby improving coercive force of the magnet (page 1, column 2, lines 9 through 21, of the official gazette of the patent specification). The thus obtained coercive force of the magnet varies within the range of between approximately 2 KOe and 30 KOe, depending on the ratio of Cu to Co (FIG. 2 attached to the above-mentioned patent specification). A typical energy product value of the magnet disclosed in U.S. Pat. No. 3,560,200 is in excess of 9 million G·Oe with regard to the preferred composition of the magnet.

The prior art further includes Japanese Patent Application Laid Open No. 49-104192, which teaches to adjust the Cu content in the RCo type permanent magnet to create the energy product of 17 MG·Oe.

It is also known from the Summary of the 74th Lecture of the Japan Institute of Metals, 1974, page 175, and Japanese Patent Application Laid Open No. 50-94498 that both the contents of Cu, which is added to the $R_2Co_{17}$ type permanent magnet, and Fe are adjusted from a view point of securing excellent magnetic properties of the RCo type magnet. According to the statements in the above-mentioned Summary, the coercive force of this alloy steeply decreases below 2 KOe with an amount of Cu decreasing from 10% by weight and, thus, the Cu content should be from 10 up to 12% by weight of the alloy. In addition, according to the Japanese Patent Application Laid Open No. 50-111599, the Cu, which is added to the ternary alloy system of Sm-Co-Fe, exerts, with the increase in the Cu content, contrary effects on the magnetic property of the alloy, such that the coercive force increases and the residual magnetization decreases with the increase in the Cu content. It was, therefore, impossible to attain a high, excellent energy product, by the aid of the addition of Cu, because the coercive force increases but the residual magnetization decreases with an increase in the Cu content. Still further, the partial replacement of Co with Fe, thereby obtaining the quaternary alloy system of Sm-Co-Cu-Fe, contributes to the enhancement of the residual magnetization Br, however, the inclusion of Fe in excess of 6% by weight leads to the reduction of the coercive force of the alloy. It was, therefore, impossible to obtain high, excellent magnetic properties with the aid of inclusion of Fe, because the residual magnetization increases but the coercive force decreases with an increase in the Fe content.

In summary, it was previously impossible to obtain high coercive force with the compositions of low Cu and high Fe having high residual magnetization, so that magnetic properties, especially energy product, were not enhanced.

It is an object of the present invention to provide an improved permanent magnet of rare earth cobalt type with addition of Cu or both Cu and Fe, in which the magnetic properties are superior to those of alloys containing Cu or both Cu and Fe.

It is a specific object of the present invention to increase the coercive force of an RCo permanent magnet with an addition of from 10 to 12% by weight of copper, wherein the R component is at least one rare earth metal, and the Co component is cobalt or both cobalt and iron, which replaces a part of the cobalt until the iron content amounts to 6% by weight at the maximum, the contents of the R and Co components being the balance, preferably, from 24 to 28% by weight and from 56 to 70.8% by weight, respectively.

It is an important object of the present invention to provide a permanent magnet material having high coercive force and, thus, high energy product with regard to the compositions of low Cu and high Fe, which previously provided the magnet with only high residual magnetization but not the high coercive force.

In all of the above-mentioned objects, the intended energy product should be achieved in the enlarged composition ranges of Cu and Fe.

It is also an object of the present invention to provide a process for providing alloy compositions according to the present invention with the optimum magnetic properties.

It has now been found by the Inventors that an additional metallic elements illustrated hereinbelow brings about the basic improvement of the ternary R-Co-Cu system, permanent magnet.

It was found that the combined addition of Nb, V, Ta and Zr not only realizes the advantages by the single addition of these elements, but also further elevates the coercive force of the ternary or quaternary alloy for a permanent magnet. The advantages of the single addition is illustrated in the U.S. Patent Application filed by several of the Inventors of the present invention.

The additional metallic elements according to the present invention are a combination of at least two elements selected from the group consisting of niobium, vanadium, tantalum and zirconium. According to these additional elements, the Cu can be reduced to 5% by weight, without adverse effects on the magnetic properties of the permanent magnet. Further, cobalt can be replaced with iron in an amount higher than previously possible, according to the additional elements. Without the addition of the elements, according to the present invention, the coercive force steeply decreases with an increase in the Fe content. However, according to the present invention, the coercive force is maintained at almost same value over a wide range of the Fe content and is still high at the upper limit thereof, depending upon the kind of additional elements, so that the energy product is considerably increased without adverse effects on the magnetic properties of the permanent magnet.

When at least, two of the elements Nb, V, Ta and Zr are added to the RCo type alloy with the addition of Cu, cobalt can be replaced with up to 23% by weight of iron based on the weight of the permanent magnet.

The present invention is further illustrated with regard to the chemical compositions of the permanent magnet according to several embodiments thereof.

According to an embodiment of the present invention, a permanent magnet essentially consists of from 24 to 28%, preferably from 25 to 27%, of at least one rare earth metal, from 55 to 70.8%, preferably from 61.5 to 67.5% of cobalt, from 5 to 12%, preferably 7 to 9%, of copper and from 0.2 to 5%, preferably 0.5 to 2.5% of at least two elements of the group consisting of niobium, vanadium, tantalum and zirconium. When the content of said at least two elements does not fall within the range of from 0.2 to 5% by weight, both the coercive force and energy product are too low. In this embodiment with the addition of at least two of Nb, V, Ta and Zr, the cobalt can be replaced with up to 23% by weight of iron based on the weight of the permanent magnet.

According to a still further embodiment of the present invention, a permanent magnet essentially consists of from 24 to 28%, preferably from 25 to 27%, of at least one rare earth metal, from 55 to 70.8%, preferably from 61.5 to 67.5%, of cobalt, from 5 to 12%, preferably 7 to 9%, of copper and from 0.2 to 5%, preferably 0.5 to 2.5%, of zirconium, all percentages being by weight. When the Zr content does not fall within the range of from 0.2 to 5% by weight, both the coercive force and energy product are too low. The cobalt can be replaced with from more than 15 to 20% by weight of iron, based on the weight of magnet. When the replacing amount of cobalt with iron exceeds 20% by weight, the coercive force is too low to use the magnet for practical applications.

In all the permanent magnets according to the present invention, when the content of rare earth metal or metals exceeds 28% by weight, the residual magnetization is reduced, and its content below 24% leads to the reduction of the coercive force.

The permanent magnet according to the present invention can be produced by melting the required ingredients, solidifying the obtained molten metal in a mold, and crushing and pulverizing the obtained ingot, so as to subject the obtained powder to sintering. The ingredients can be pure Nb, Zr, V, Ta etc. or their alloys with Fe. The pulverizing is performed to produce powders having an average grain size of from 3 to 5 microns, by using a vibrating mill or, preferably, a jet mill. The employment of a jet mill enables the coercive force and the energy product to be increased. In the alloy compositions of the present invention, the coercive force and the energy product are increased by approximately 0.5 to 1 KOe and 1 to 2 MG Oe, respectively. The best magnetic properties of the R-Co-Cu-Fe-Zr alloys produced by the steps including the pulverizing by the jet mill, the hereinbelow illustrated solution treatment and step tempering are 11.1 KG of the residual magnetization, 6.7 KOe of coercive force and 30 MG·Oe of energy product.

The powder is then pressed at a pressure, typically 1.5 ton/cm$^2$, in a magnetic field, typically 10 KOe, to produce green compact bodies. The green compact bodies are sintered at a temperature of from 1160° to 1230° C. The sintered bodies are cooled and, then, solution treated at a temperature from 1160° to 1250° C. over a period of from 0.5 to 3 hours, typically one hour, under a vacuum- or inert-atmosphere. It is preferable to perform the solution treatment at a low temperature from 1100° to 1170° C., particularly when the Zr is added to the R-Co-Cu alloy and Co is replaced with an increased amount of Fe of up to 20%. Due to the solution treatment at low temperature, the high coercive force can be maintained and, simultaneously, the residual magnetization, and thus, the energy product increases even with an increase in the Fe content. When the replacing amount of Fe is zero or low, the sintered bodies can be directly subjected to the following tempering.

The solution treatment is followed by rapid cooling. Subsequently, the sintered article is tempered at a temperature of from 400° to 900° C., over a period of 0.3 to 24 hours. The preferable tempering process is a step tempering, wherein the tempering temperature is stepwise lowered from a beginning temperature of 750° to 900° C. down to a final temperature of 400° C. The more the number of steps, i.e. a temperature at which the sintered article is maintained for a certain period time, the better will be several of the magnetic properties of the sintered article. The number of steps should preferably be not less than two. When this number is increased to an infinite value, the tempering is performed by continuously cooling the sintered body from the beginning to final temperature. The tempering time at each step should preferably be not less than 24 hours. The step tempering increases the coercive force, for example as much as twice the ordinary tempering at a particular temperature.

The processes according to the invention provide, the advantages of enhancing the recovery of the produced alloys having stable magnetic properties, in addition to enhancing the magnetic properties of the alloys.

Figure 1:
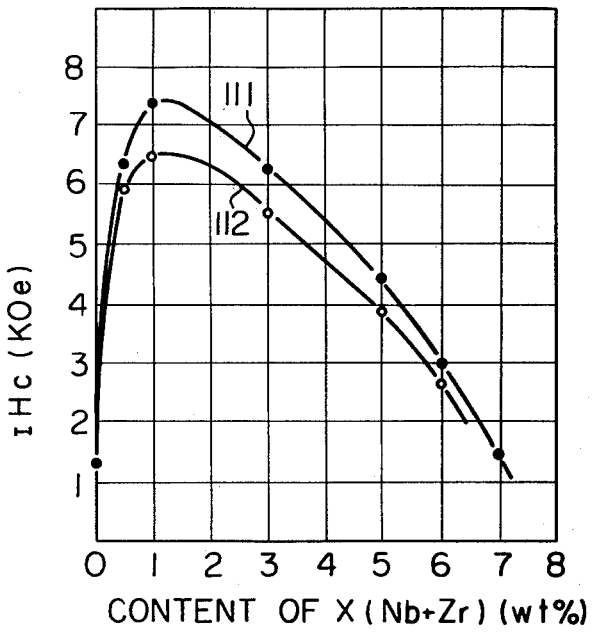
FIG. 1 describes Niobium+Zirconium content function.

The invention will be understood more readily by reference to the following Examples; however these Examples are intended to illustrate the invention and are not to be construed as limiting the scope of the invention.

EXAMPLE 1

The required ingredients for the alloy compositions Nos. 101 through 110 as illustrated hereinbelow in Table 1 were dosed and the alloy mixtures were melted in an induction furnace under an argon atmosphere. The melt was cast into an iron pan to produce ingots. The ingots were roughly crushed in an iron mortar and finely crushed to powders having an average particle size of approximately 5 microns by using the vibrating mill. The powders were pressed and shaped under a magnetic field of 10 KOe and the so produced green compact bodies were sintered at a temperature of from 1230° to 1250° C. over a period of one hour. The cooled, sintered bodies were heated in a temperature range from 800° to 900° C. over a period of one hour and, subsequently, at a temperature of 500° C. over a period of five hours.

The permanent magnets, which were produced by the above-mentioned procedure, were subjected to measurement of magnetic properties, i.e. the residual magnetization, coercive force and energy product designated in the following Tables as Br, iHc and (B·H)-max, respectively.

Specimens Nos. 101 through 110, having the compositions shown in Table 1, were produced in accordance with the procedure described above.

Table 1

| Sample No. | Composition of Alloys (wt. %) Co | Sm | Cu | Fe | Nb | Zr | Ta | V | Br (KG) | iHc (KOe) | (B . H)m (MG . Oe) |
|---|---|---|---|---|---|---|---|---|---|---|---|
| 101. (control) | bal | 26.5 | 8 | 5 | 0 | 0 | 0 | 0 | 9.2 | 3.0 | 12.0 |
| 102. (control) | bal | " | " | " | 1 | 0 | 0 | 0 | 9.1 | 5.7 | 20.0 |
| 103. (control) | bal | " | " | " | 0 | 1 | 0 | 0 | 9.1 | 6.5 | 20.5 |
| 104. (control) | bal | " | " | " | 0 | 0 | 1 | 0 | 9.1 | 5.6 | 20.0 |
| 105. (control) | bal | " | " | " | 0 | 0 | 0 | 1 | 9.1 | 6.2 | 20.3 |
| 106. (invention) | bal | " | " | " | 0.5 | 0.5 | 0 | 0 | 9.2 | 7.3 | 21.0 |
| 107. (invention) | bal | " | " | " | 0.5 | 0 | 0.5 | 0 | 9.1 | 7.0 | 20.6 |
| 108. (invention) | bal | " | " | " | 0.5 | 0 | 0 | 0.5 | 9.1 | 7.1 | 20.6 |
| 109. (invention) | bal | " | " | " | 0 | 0.5 | 0.5 | 0 | 9.2 | 7.2 | 20.9 |
| 110. (invention) | bal | " | " | " | 0.4 | 0.3 | 0.3 | 0 | 9.2 | 7.3 | 21.0 |

Specimen No. 101 relates to a conventional, quaternary Sm-Co-Fe-Cu alloy. Specimen Nos. 102 through 105 were control specimens with the single addition of one of the elements Nb, Zr, Ta and V to the quaternary alloy, and were tested for comparison purposes with the addition of the two or three elements into the specimens Nos. 106 through 110. As is clear from the above Table, the multiple addition according to the specimens Nos. 106 through 110 improves the iHc, and thus the (B·H)-max more than does the single addition into the quaternary alloy (No. 101) according to the specimens Nos. 102 through 105. For example, if the energy product of control Sample 105 were increased 0.5 KOe by following the present invention, one would obtain an energy product of 6.7 KOe. The present invention in the instance of comparing Sample No. 110 with control Sample No. 104 shows an improvement in the energy product of 1.7 KOe.

EXAMPLE 2

Specimen Nos. 111 and 112, having the compositions shown in Table 2, were produced in accordance with the procedure described in Example 1. The total contents of Nb+Zr were varied within the ranges shown in Table 2.

Table 2

| Specimen No. | Composition of Alloys (wt. %) Sm | Cu | Fe | X | Nb | Co |
|---|---|---|---|---|---|---|
| 111. (invention) | 26.5 | 8.0 | 10.0 | 0–7 | — | bal |
| 112. (control) | 26.5 | 8.0 | 10.0 | 0 | 1 | bal |

In the above Table the X component indicates the combination of nb and zr.

The influence of the content of X on the coercive force is illustrated in FIG. 1, in which the reference numerals 111 and 112 indicate specimens 111 and 112, respectively. As is clear from FIG. 1, the iHc arrives at the maximum value at approximately 1% by weight of X. The iHc is too low when the content of X exceeds 5% by weight. The iHc is extremely high at the content of X from 0.5 to 2.5% by weight. The effects of the addition of Nb and Zr are superior to that of a single addition of Nb over almost all ranges of the X component.

EXAMPLE 3

Specimen No. 113, having the composition shown in Table 3, was produced using the same procedure as described in Example 1.

Table 3

| Specimen No. | Composition of Alloy (wt. %) Sm | Cu | Fe | Nb + Zr | Co |
|---|---|---|---|---|---|
| 113 | 26.5 | 8.0 | 0–25 | 1.0 | bal |

The weight ratio of Nb to Zr of specimen No. 113 was 1:1. The Fe content was changed within the range as shown in Table 3.

Figure 2:
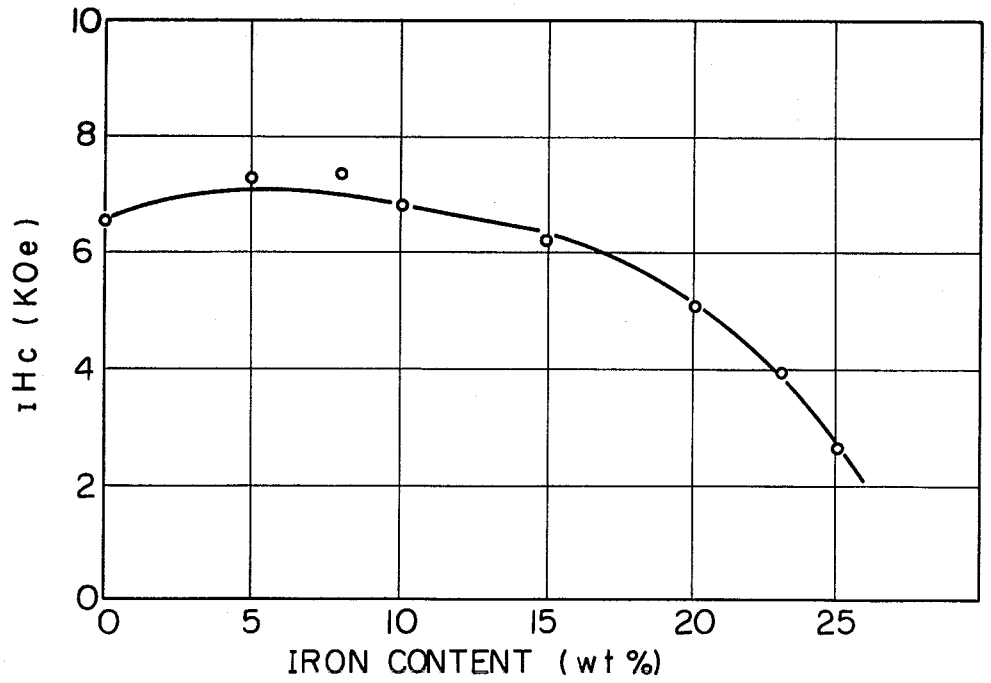
FIGS. 2,3 describe iron content function.

The influence of the Fe content upon the coercive force is illustrated in FIG. 2. When the Fe content exceeds 23% by weight, the iHc becomes too low, as readily seen in FIG. 2.

EXAMPLE 4

Specimen No. 114, having the composition shown in Table 4 was produced using the same procedure as described in Example 1, except for the sintering and heat treatment conditions as illustrated hereinbelow.

Table 4

| Specimen No. | Composition of Alloy (wt. %) Sm | Cu | Fe | Zr | Co |
|---|---|---|---|---|---|
| 114 | 26 | 8 | 15–22 | 1.2 | bal |

The Fe content was changed within the range shown in this Table. Specimen No. 114 contained more Fe than the conventional, quaternary alloy and even more than the alloy having the one additive of Zr added into the quaternary alloy according to the U.S. application mentioned in the objects of the present invention.

The green compacts of specimen No. 114 were sintered at temperature of from 1150° to 1200° C., over a period from 1 to 2 hours, in a vacuum or inert atmosphere, and subsequently, after cooling to room temperature, were solution treated at temperature of from 1100° to 1170° C., followed by cooling to room temperature. The tempering was preformed by a step tempering of from 850° to 400° C. The temperature was decrease stepwise at each 100° C.

Figure 3:
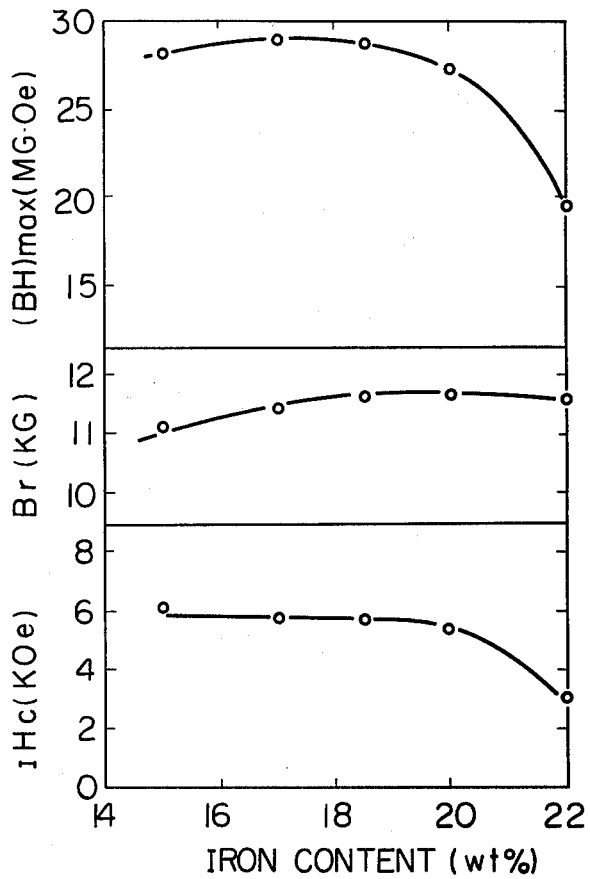

The influence of the Fe content on the magnetic properties i.e. iHc, Br and (B·H)max, shown in the ordinate, is illustrated in FIG. 3. It is possible to conclude the following from FIG. 3. (1) Br still increases with increase in the Fe content. (2) The iHc value is at an almost constant level of 6 KOe at the Fe content of from 15 to 20%. (3) The (B·H)max value is almost at a constant level of approximately 28 MG·Oe over a wide range of Fe from 15 to 20%.

EXAMPLE 5

Specimens Nos. 115 and 116, having the compositions as shown in Table 5, were produced using the same procedure as described in the proceeding Example, except for the solution temperatures.

Table 5

| Specimen No. | Chemical Compositions (wt. %) Sm | Cu | Fe | Zr | Co | Solution Temperature (°C.) |
|---|---|---|---|---|---|---|
| 115 | 26 | 8 | 17 | 1.2 | bal | 1140–1170 |
| 116 | 26 | 8 | 15 | 1.2 | bal | 1160–1190 |

Figure 4:
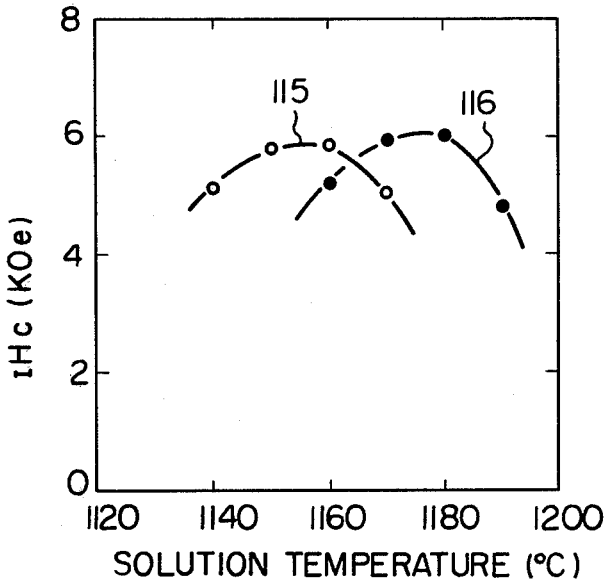
FIG. 4 solution temperature function is described.

The effects of the solution temperature on the coercive force is illustrated in FIG. 4. As is clear from this figure the solution temperature should be lower for the higher Fe content from the point of view of high iHc.

What is claimed is:

1. A permanent magnet of $R_2Co_{17}$ type crystal structure consisting essentially of at least one rare earth metal in an amount of from 24 to 28% by weight, copper in an amount of from 5 to 12% by weight, a total combined amount of cobalt and iron from 55 to 70.8% by weight, said iron being present in an amount of up to 23% by weight, and at least two elements selected from the group consisting of niobium, vanadium, tantalum and zirconium in an amount of from 0.2 to 5% by weight, the amount of each of said elements being sufficient to create a substantial increase in the coercive force of said magnet compared to the coercive force of a magnet obtained by the inclusion of only one of said elements, said coercive force being increased about 0.5 KOe to 1.7 KOe, all percentages being based on the total weight of said magnet.

2. A permanent magnet according to claim 1, wherein said rare earth metal is present in an amount of from 25 to 27% by weight, said combined amount of cobalt and iron is from 61.5 to 67.5% by weight, said amount of copper is from 7 to 9% by weight and said amount of elements is from 0.5 to 2.5% by weight.

3. A permanent magnet according to claim 1 wherein said amount of each of said elements present is about equal.

4. A permanent magnet of $R_2Co_{17}$ type crystal structure consisting essentially of at least one rare earth metal in an amount of from 24 to 28% by weight, copper in an amount of from 5 to 12% by weight, a total combined amount of cobalt and iron being from 55 to 70.8% by weight, said iron being present in an amount of up to 23% by weight and at least two elements selected from the group consisting of niobium, vanadium, tantalum and zirconium in an amount of from 0.2 to 5% by weight, the amount of each of said elements being sufficient to maintain the coercive force of said magnet at about the same level throughout said percentage range of said iron, said coercive force being about 7 KOe, all percentages being based on the total weight of said magnet.

5. A permanent magnet according to claim 4 wherein said amount of each of said elements present is about equal.

6. A permanent magnet according to claim 4 wherein said amount of rare earth metal is from 25 to 27% by weight, said combined amount of cobalt and iron is from 61.5 to 67.5% by weight, said amount of copper is from 7 to 9% by weight and said amount of elements is from 0.5 to 2.5% by weight.

7. A permanent magnet of $R_2Co_{17}$ type crystal structure consisting essentially of rare earth metal in an amount of from 24 to 28% by weight, copper in an amount of from 5 to 12% by weight, iron in an amount of from 15 to 20% by weight, a total combined amount of cobalt and iron being from 55 to 70.8% by weight, and a combination of zirconium and niobium in an amount of from 0.2 to 5% by weight, all percentages being based on the total weight of said magnet said magnet having an energy product of between about 20.6 and 28 MG·Oe.

8. A permanent magnet according to claim 7, wherein said rare earth metal is present in an amount of from 25 to 27% by weight, said combined amount of cobalt and iron is from 61.5 to 67.5% by weight, said amount of copper is from 7 to 9% by weight and said amount of zirconium and niobium is from 0.5 to 2.5% by weight.

9. A process for producing a permanent magnet of $R_2Co_{17}$ type crystal structure having a composition consisting essentially of rare earth metal in an amount of from 24 to 28% by weight, copper in an amount of from 5 to 12% by weight, a total combined amount of cobalt and iron being from 55 to 70.8% by weight, said iron being present in an amount of up to 23%, and at least two elements selected from the group consisting of niobium, vanadium, tantalum and zirconium in an amount of from 0.2 to 5% by weight, the amount of each of said elements being sufficient to create a substantial increase in the coercive force of said magnet compared to the coercive force of a magnet obtained by the inclusion of only one of said elements, said coercing force being in the range of about 6.7 and 7.3 KOe, all percentages being based on the total weight of said magnet, said process comprising the steps of sintering powders having said composition, and tempering the sintered bodies wherein the tempering temperature is lowered stepwise from a temperature not greater than 900° to 400° C., the number of tempering steps being at least two.

10. A process for producing a permanent magnet of $R_2Co_{17}$ type crystal structure having a composition consisting essentially of rare earth metal in an amount of from 24 to 28% by weight, copper in an amount of from 5 to 12% by weight, a total combined amount of cobalt and iron in an amount of 55 to 70.8% by weight, said iron being present in an amount of up to 23% by weight, and least two elements selected from the group consisting of niobium, vanadium, tantalum and zirconium in an amount of from 0.2 to 5% by weight, the amount of each of said elements being sufficient to maintain the coercive force of said magnet at about the same level throughout said percentage range of said iron, said coercive force being about 6 KOe, all percentages being based on the total weight of said magnet, said process comprising the steps of sintering powders having said composition, and tempering the sintered bodies wherein the tempering temperature is lowered stepwise from a temperature not greater than 900° to 400° C., the number of tempering steps being at least two.

11. A process for producing a permanent magnet $R_2Co_{17}$ type crystal structure consisting essentially of rare earth metal in an amount of from 24 to 28% by weight, copper in an amount of from 5 to 12% by weight, iron in an amount of from 15 to 20% by weight, a total combined amount of cobalt and iron in an amount of from 55 to 70.8% by weight, and a combined amount of niobium and zirconium in an amount of from 0.2 to 5% by weight, all percentages being based on the total weight of said magnet, said process comprising the steps of sintering powders having said composition, and tempering the sintered bodies wherein the tempering temperature is lowered stepwise from a temperature not greater than 900° C. to 400° C., the number of tempering steps being at least two said magnet having an energy product of about 21 MG·Oe.

12. A process according to claim 11 further comprising the step of subjecting said sintered body to a solution temperature of 1,100° to 1,170° C.

13. A permanent magnet of $R_2Co_{17}$ type crystal structure made of an alloy of rare earth metal, cobalt, iron, copper and at least two niobium metal elements, essentially consisting of an intermetallic compound including said rare earth metal in an amount of from 24 to 28% by weight, said copper in an amount of from 5 to 12% by weight and said cobalt and iron in an amount of from 55 to 70.8% by weight, a combination of at least two niobium metal elements selected from the group consisting of niobium, vanadium, tantalum and zirconium in an amount of from 0.2 to 5% by weight, said iron being present in an amount of from 5 to 23% by weight, and said permanent magnet exhibiting an energy product of at least 20.6 MG·Oe due to the inclusion of said at least two elements and said replacing amount of said iron.

14. A permanent magnet according to claim 13, wherein the amount of each of said elements is about equal.

15. A permanent magnet according to claim 13, wherein said permanent magnet is produced by the process comprising the steps of sintering powders having the composition of said permanent magnet, and tempering the sintered bodies wherein the tempering temperature is lowered stepwise from a temperature of not greater than 900° C. to 400° C., the number of tempering steps being at least two, and the temperature of the first tempering step is in the range of from 750° C. to 900° C.

16. A permanent magnet according to claim 15, wherein the amount of said rare earth metal is from 25 to 27% by weight, the combined amount of said cobalt and iron is from 61.5 to 67.5% by weight, the amount of said copper is from 7 to 9% by weight and the amount of said elements is from 0.5 to 2.5% by weight.

17. A permanent magnet according to claim 16, wherein the amount of each of said elements is about equal.

18. A permanent magnet according to claim 17, wherein said elements are tantalum and niobium.

19. A permanent magnet according to claim 17, wherein said elements are zirconium and niobium.

20. A permanent magnet according to claim 17, wherein said elements are tantalum and zirconium.

21. A process for producing a permanent magnet of $R_2Co_{17}$ type crystal structure made of an alloy of rare earth metal, cobalt, iron, copper and at least two niobium metal elements, said alloy essentially consisting of said rare earth metal in an amount of from 24 to 28% by weight, said iron in an amount of from 5 to 23%, said copper in an amount of from 5 to 12% by weight, the combination of iron and cobalt in an amount of from 55 to 70.8% by weight, and at least two niobium metal elements selected from the group consisting of niobium, vanadium, tantalum and zirconium in an amount of from 0.2 to 5% by weight, all percentages being based on the total weight of said magnet, said process comprising the steps of sintering powders having said composition of said permanent magnet, and tempering the sintered bodies wherein the tempering temperature is lowered stepwise from a temperature of not greater than 900° C. to 400° C., the number of tempering steps being at least two, the temperature of the first tempering step being in the range of from 750° C. to 900° C.

22. A process according to claim 21, wherein the amount of said rare earth metal is from 25 to 27% by weight, the amount of said cobalt and iron is from 61.5 to 67.5% by weight, the amount of said copper is from 7 to 9% by weight and the amount of said elements is from 0.5 to 2.5% by weight.

23. A process according to claim 22, wherein the amount of each of said elements is about equal.

24. A process according to claim 22, wherein said elements are tantalum and niobium.

25. A process according to claim 22, wherein said elements are zirconium and niobium.

26. A process according to claim 22, wherein said elements are tantalum and zirconium.

27. A permanent magnet of $R_2Co_{17}$ type crystal structure made of a rare earth metal, cobalt, iron, copper and at least two niobium metal elements, an alloy system of at least one rare earth metal in an amount of from 24 to 28% by weight, said copper in an amount of from 5 to 12% by weight, the combination of said cobalt and iron is in an amount of from 55 to 70.8% by weight, a combination of at least two elements selected from the group consisting of niobium, vanadium, tantalum and zirconium in an amount of from 0.2 to 5% by weight and, said iron is present in an amount of from 5 to 23% by weight, and said magnet exhibits an energy product of at least 20.6 MG·Oe, due to the inclusion of said at least two elements and said replacing amount of said iron.

28. A permanent magnet according to claim 27, wherein the amount of said rare earth metal is from 25 to 27% by weight, the amount of said cobalt is from 61.5 to 67.5% by weight, and the amount of said copper is from 7 to 9% by weight.

29. A permanent magnet according to claim 28 wherein said elements are tantalum and niobium.

30. A permanent magnet according to claim 28, wherein said elements are zirconium and niobium.

31. A permanent magnet according to claim 28, wherein said elements are tantalum and zirconium.

32. A process for producing a permanent magnet of $R_2Co_{17}$ type crystal structure made of an alloy system of rare earth metal, cobalt, iron, copper and at least two niobium metal elements, essentially consisting of an intermetallic compound of said rare earth metal in an amount of from 24 to 28% by weight, said iron in an amount of from 5 to 23%, said copper in an amount of from 5 to 12% by weight, the combination of said cobalt and iron in an amount of from 55 to 70.8% by weight, and at least two niobium metal elements selected from the group consisting of niobium, vanadium, tantalum and zirconium in an amount of from 0.2 to 5% by weight, all percentages being based on the total weight of said magnet, said process comprising the steps of sintering powders having said composition, and tempering the sintered bodies wherein the tempering temperature is lowered stepwise from a temperature of not greater than 900° C. to 400° C., the number of tempering steps being at least two, the temperature of the first tempering step being in the range of from 750° C. to 900° C. and said permanent magnet exhibiting an energy product of at least 20.6 MG·Oe due to the inclusion of said at least two elements and said amount of iron.

33. A process according to claim 32, wherein said permanent magnet is produced by the process comprising the steps of sintering powders having said composition, and tempering the sintered bodies wherein the tempering temperature is lowered stepwise from a temperature of not greater than 900° C. to 400° C., the number of tempering steps being at least two, and the temperature of the first tempering step is in the range of from 750° C. to 900° C.

34. A process according to claim 33, wherein said elements are tantalum and niobium.

35. A process according to claim 33, wherein said elements are zirconium and niobium.

36. A process according to claim 33, wherein said elements are tantalum and zirconium.

* * * * *

UNITED STATES PATENT AND TRADEMARK OFFICE

CERTIFICATE OF CORRECTION

PATENT NO. : 4,213,803

DATED : July 22, 1890

INVENTOR(S) : Tetsuhito Yoneyama, Shiro Tomizawa, Tetsuo Hori, and Teruhiko Ojima It is certified that error appears in the above-identified patent and that said Letters Patent are hereby corrected as shown below:

Column 6, line 53, "preformed" should be --performed--;

Column 8, line 43, after "and" insert --at--;

Column 9, line 2, after "two" insert --,--;

line 2, "magnet" should be --magnets--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*